United States Patent [19]

Hunt

[11] Patent Number: 4,896,472

[45] Date of Patent: Jan. 30, 1990

[54] BUILDING BLOCK AND SYSTEM

[76] Inventor: Terance J. Hunt, 2016 Fairmeadow Dr., Richardson, Tex. 75080

[21] Appl. No.: 300,203

[22] Filed: Jan. 23, 1989

Related U.S. Application Data

[63] Continuation of Ser. No. 11,078, Feb. 5, 1987, abandoned, which is a continuation-in-part of Ser. No. 766,125, Aug. 15, 1985, abandoned.

[51] Int. Cl.[4] ..... E04C 1/10

[52] U.S. Cl. ..... 52/593

[58] Field of Search ..... 52/593, 286, 562, 590

[56] References Cited

U.S. PATENT DOCUMENTS

| | | | |
|---|---|---|---|
| 1,191,364 | 7/1916 | Straight . | |
| 2,019,653 | 11/1935 | Buyer | 52/593 |
| 2,861,388 | 11/1958 | Favaretto | 52/593 |
| 3,888,060 | 10/1975 | Haewer | 52/286 |
| 4,186,540 | 2/1980 | Mullins | 52/593 |
| 4,426,815 | 1/1984 | Brown | 52/593 |
| 4,671,039 | 6/1987 | Hunt | 52/593 |

FOREIGN PATENT DOCUMENTS 1142773 3/1983 Canada .

*Primary Examiner*—John E. Murtagh
*Attorney, Agent, or Firm*—Frost & Jacobs

[57] ABSTRACT

The invention is a construction system based on the combined use of blocks designed to lock together. There are three basic blocks, the full, half and knock-out blocks, with which any desirable structure can be built. The full block has protruding ears and grooves. The half block and the knock-out block have grooves only. There are standard measurements between groove faces in all blocks and standard measurements between ears in the full block which correspond to the measurements of the groove faces. This provides for a wide array of interlocking positions.

12 Claims, 8 Drawing Sheets

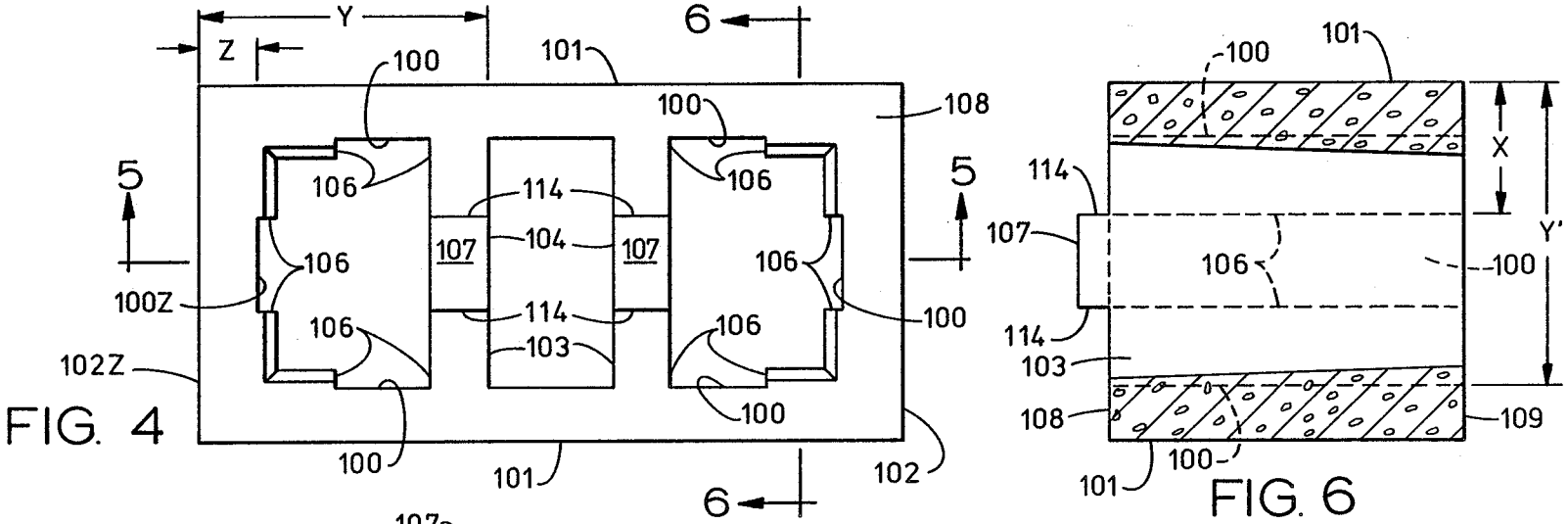
FIG. 4
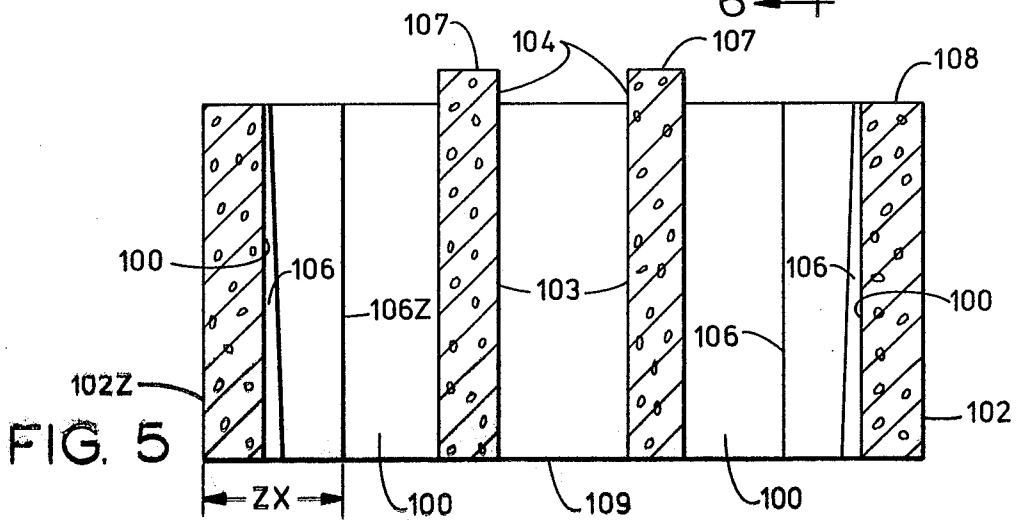
FIG. 5
FIG. 6

BUILDING BLOCK AND SYSTEM

This is a continuation of application Ser. No. 011,078, filed Feb. 5, 1987, now abandoned, and a continuation-in-part of Ser. No. 766,125, filed Aug. 15, 1985, now abandoned.

BACKGROUND OF THE INVENTION

The invention relates to a building block and system to facilitate the construction of buildings, walls, cross walls and the like without the need of special equipment or techniques. The essential idea is to provide a full block and a system using the full and two other types of interlocking blocks, the basic system being three blocks. The blocks are designed to firmly lock together and thus the construction does not require the traditional mortar or cement to bond it together. This is due to the selection and position ears protruding from at least the full block and grooves all of the blocks that fit on said protruding ears. As a result, it is possible to interlock said blocks in parallel, longitudinally or transversely. Thus, with this system any simple or complex structure may be built.

The state of the art is still complex and costly and is far behind the invention herein described because too many differently shaped blocks must be used in combination and/or because manufacturing, stocking, selecting and assembling so great a number of blocks defeats the idea of facilitating construction. Also, such complications increase costs and require skilled personnel to allot the type of blocks that will be used in a particular building. Workmen certainly need some skills to control inventories and select the proper blocks that may be needed. For example, Canadian Patent 1,142,773 relates to a block having a distinctive manner of fitting together, male-female, to form beams or doorheads with pillars going through them, or to form channels for internal line or cable ducts. This system does not require skilled workmen. However, it needs special machinery for its manufacture. It also requires many forms of blocks to obtain building configurations such as corners, columns, cross-walls, etc.

An object of the invention is to provide three blocks with which any desired structure can be built.

Another object is to obtain a construction system which does not require special equipment or skilled workmen.

A further object is to provide the means for precision molding of blocks.

Another object is to use as few molds as possible to reduce manufacturing costs.

Another object is providing blocks which may be easily cubed for transportation and stocking.

Another object is to make it easy for the builder to choose and use the blocks.

BRIEF DESCRIPTION OF THE DRAWINGS

Merely-preferred embodiments, which do not limit the invention, are shown in drawings, wherein:

FIG. 4 is a top plan view of the full block.

FIG. 5 is a longitudinal, side cross-section view of FIG. 4 at lines V—V.

FIG. 6 is a transverse, end cross-section view of FIG. 4 at lines VI—VI.

DESCRIPTION OF THE PREFERRED EMBODIMENTS

Figure 1:
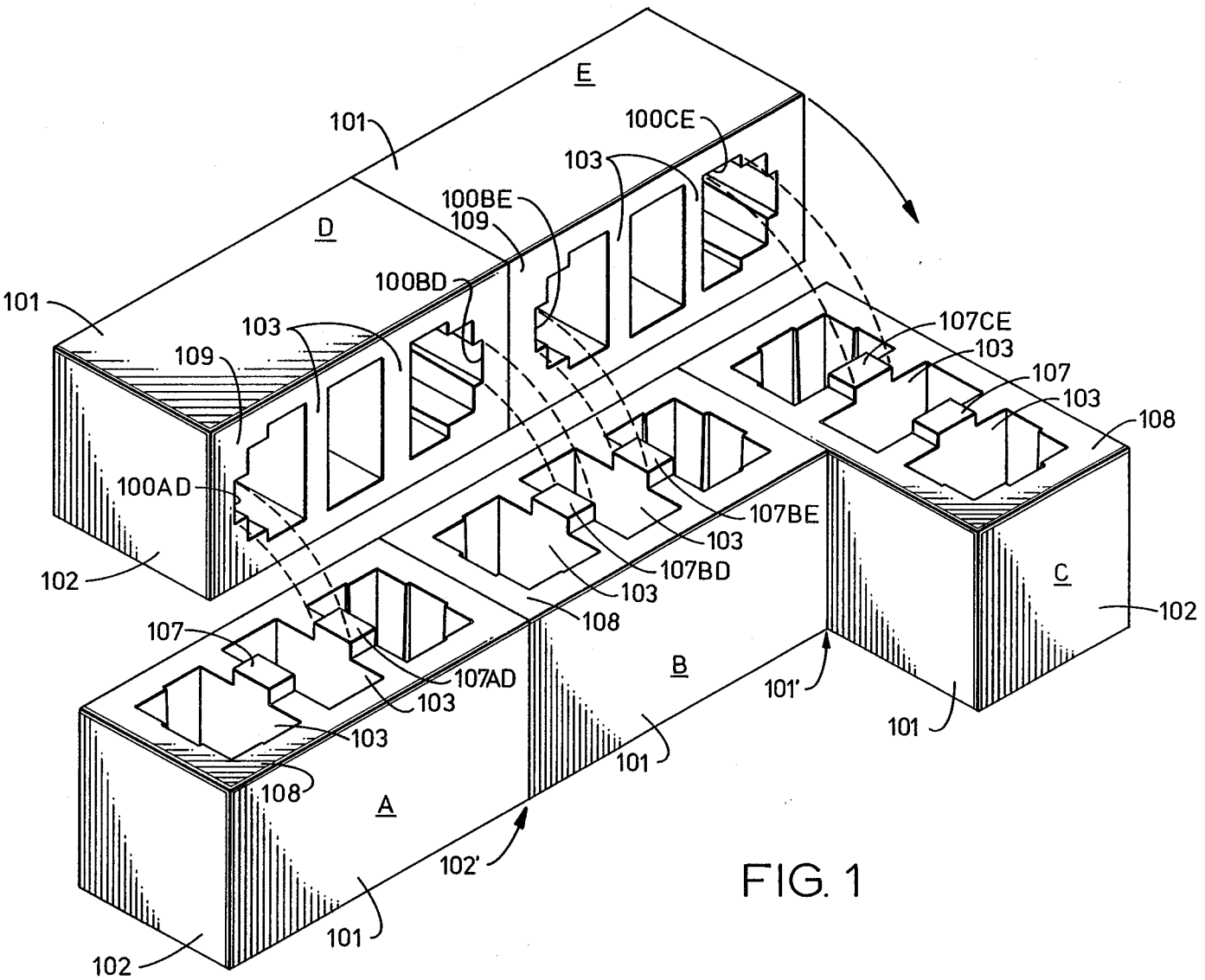
FIG. 1 is a perspective top and bottom view of a group of full blocks.

The system comprises the combination of three basic building blocks: a full block, half block, and knock-out block.

These blocks should be manufactured with precision for interlocking without the use of mortar. Load-bearing structures can be built therewith.

THE FULL BLOCK

As shown in FIGS. 1 and 4 to 6, each full block is a rectangular configuration of two spaced, parallel end walls and two spaced, parallel side walls extending longitudinally of the block between the therefore transverse end walls. The side and end walls have respective external faces 101, 102 and define an open-ended internal cavity extending between top and bottom faces 108, 109, respectively, of the walls and, therefore, of the open-ended internal cavity.

Two middle webs 103 extend transversely of said block and, therefore, parallel to its end walls between internal faces of the side walls for separating the open-ended internal cavity into two end cavities of substantially equal size with a central cavity therebetween. Each end cavity is, therefore, defined by an internal face of one end wall, one internal face of one end wall, one internal face of one middle web, and the intervening internal faces of side walls.

An ear 107 on a central portion of each said middle web protrudes from the top face 108, each ear being of substantially the same dimensions. Each ear has a transversely extending surface 104 delimiting the extent of said ear toward said central cavity and oppositely disposed, longitudinally extending surfaces 114, each delimiting the extent of said ear toward the proximal side wall.

A groove is in the internal face of the end and side walls of each end cavity. Each said groove extends from the bottom face 109 toward the top face 108 at least as far as the ears 107 project from the top face 108. Each groove is defined y a groove face 100 and adjacent opposite side edges 106.

As shown particularly in FIG. 6, the side edges 106 of the groove in each end wall are each spaced from the external face 101 of the proximal side wall a distance x substantially the same as the distance from the longitudinally-extending surfaces 114 of the ears 107 respectively to the same, proximal side wall faces. As shown particularly in FIG. 4, each transversly-extending surface 104 of each ear is spaced from the external face 102 of the proximal end wall a distance Y substantially one half the external length of a side wall minus the distance Z of the face of the groove 100 Z in the proximal end wall to said external face 102 Z of said end wall. A shown particularly in FIG. 5, the side edge 106 Z proximal the end wall of the groove in each said side wall is substantially the same distance ZX from the external face 102 Z of said proximal end wall as the distance X (FIG. 6) of each longitudinally-extending surface 114 of each ear to the external face 101 of the proximal side wall.

As a result, as shown in FIG. 1, an ear and groove of three adjacent blocks A, B and D or B, C and E can be male-female interlocked with external side and end faces of one the blocks flush in a longitudinal orientation, like blocks A, B and D, or a transverse orientation, like blocks B, C and E. The full block is such, therefore, that three such full blocks in sequence are adapted to form a running bond of longitudinal or transverse orientation of the sequential full blocks. In the longitudinal orientation, each groove 100AD, 100BC in each end wall of one full block D respectively male-female interlocks with one ear 107AD, 107BD of each of the other two full blocks A,B, the external faces 102 (not shown in FIG. 1) of the end walls of the other full blocks A,B being in mating relationship at 102' and the external faces 101 of the side walls of each full block being parallel and respectively flush with the external faces of the side walls of each of the other full blocks. In the transverse orientation, one groove 100BE in one end wall and one groove 100CE in one side wall of one full block E respectively male-female interlocks with one said ear 107BE, 107CE of each of said other two full blocks B,C, the external faces of side walls 101 of full E block being transverse to the external faces of the side walls 101 of at least one of said other two full blocks B, C.

In other words, each groove extending from the bottom face toward the top face at least as far as the ears project from the top face is positioned, shaped and dimensioned so that an ear and groove of adjacent blocks can be male-female interlocked with one external face of one block flush with an external face of another block for either longitudinally parallel or transverse orientations of the blocks.

For the transverse orientation, as shown particularly in FIGS. 4 and 6, the distance Y' from the groove face 100 of each groove in each side wall to the external face 101 of the other side wall is substantially the same as the distance Y from the transversely extending surface 104 of each ear to the external face 102 of the end wall of the end cavity defined, in part, by the internal face of the same middle web 103 as the ear is on.

The face 100 of each groove apparently tapers toward said top face 108 so as to provide a greater groove depth adjacent the other, bottom face 109 the ears will project into. Such preferred, apparent groove taper is achieved by having the face 100 of each groove parallel to the outwardly-adjacent external end or side face 101, 102 and the internal faces and, thus, groove side edges 106 thereabout inclined inwardly of the end cavity defined thereby toward the bottom face; i.e., the thickness between the external and internal faces of the walls of each end cavity is greater at the bottom face than at the top face of said end cavities.

That is: (1) The distance between each groove face 100 and the proximate external end face 102 or side face 101 is the same and the distance between the two grooves in the side walls of each end cavity should be less than the distance between ears 107.

(2) The distance between the opposite groove face edges 106 must be greater than that between the sides 114 of ears 107.

(3) The tapered groove edge 106 is thicker at the bottom face 109 than at the top face 108. This makes for an adequate locating device when in contact with the ears 107.

(4) The middle webs 103 are placed in critical positions that ensure the exact location for the protruding ears. That makes the block system versatile.

It is desirable that each ear 107 protrudes to the extent 1/5 to 1/25 of the distance between the bottom face 109 of the block and top face 108 of the block.

THE HALF BLOCK

The half block has two sides exactly half the size of those of the full block. It can be incorporated into the system in any combination. The groove 200 in any face 201 will slide down the ear 107 of the full block for male-female fitting in any combination of end or side faces of any proceeding block, full, half or lintel.

The main function of the half block is to give any wall built with this system a straight end when using the running bond method of construction.

Figure 2:
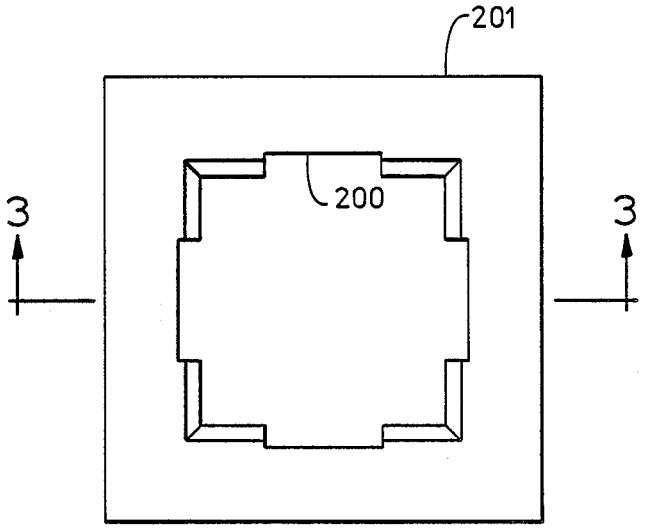
FIG. 2 is a top plan view of a half-block.

The characteristics of the half block are the greater cavity and the four internal grooves in the four internal block walls. FIG. 2 illustrates it has no protruding ears. Nevertheless, it fits with the basic block.

Figure 3:
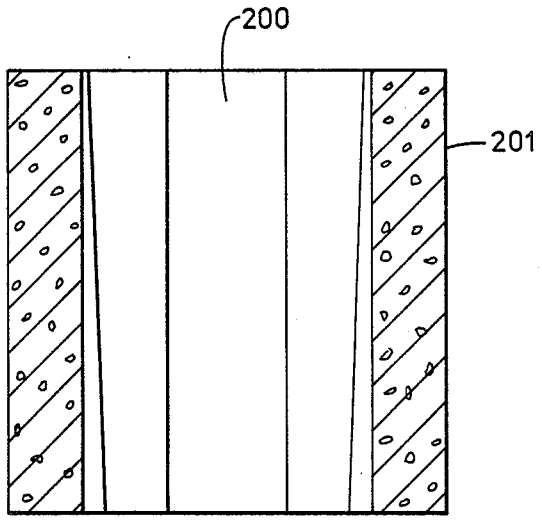
FIG. 3 is a cross-section view of FIG. 2 at lines III—III.

In short, as shown in FIGS. 2 and 3, the half block has four, rectangular walls with internal faces defining an open-ended internal cavity, two of said external faces at opposite ends of said half block each having the same configuration as said end faces of said full block, but being spaced by the other two said walls of said half block half the distance between the end walls of said full block.

THE LINTEL OR KNOCK-OUT BLOCK

Figure 9:
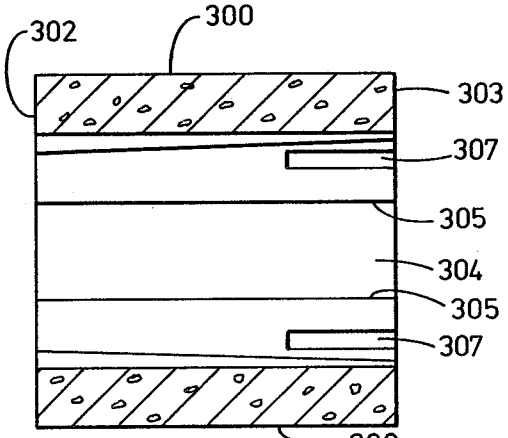
FIG. 9 is a cross-section view of FIG. 7 at lines IX—IX.
Figure 7:
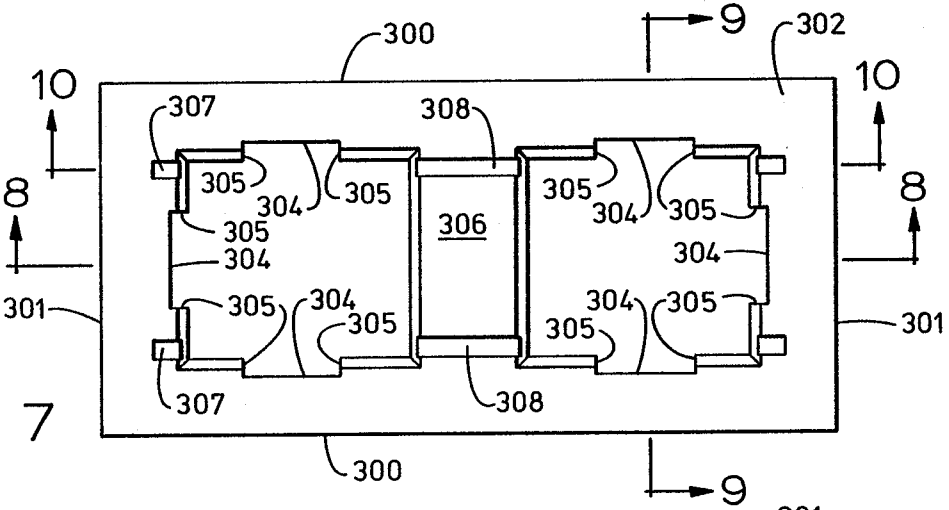
FIG. 7 is a top plan view of a knock-out block.
Figure 10:
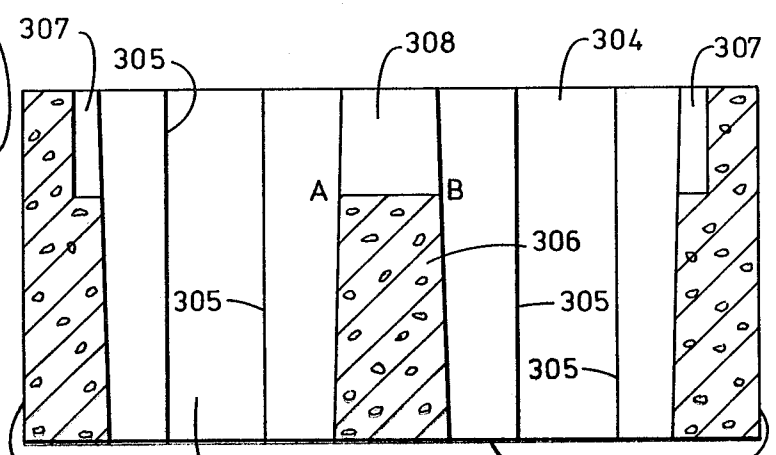
FIG. 10 is a cross-section view of FIG. 7 at lines X—X.
Figure 8:
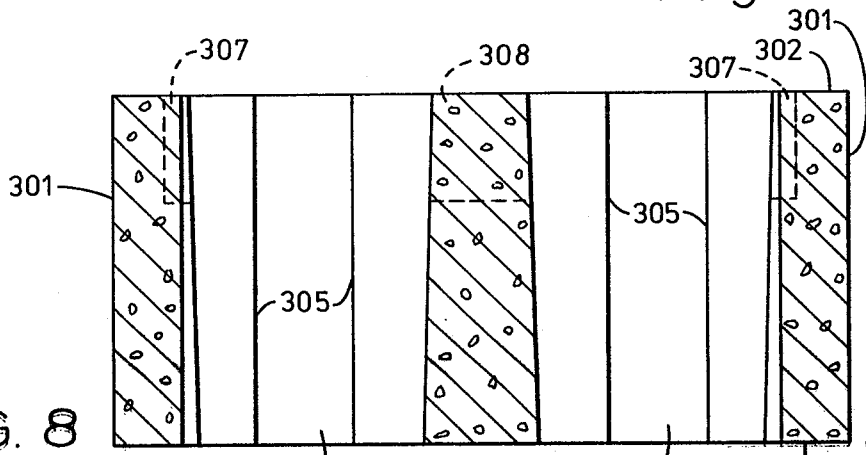
FIG. 8 is a cross-section view of FIG. 7 at lines VIII—VIII.

The main functions of the lintel or knockout block, shown in FIGS. 7 to 9 as having external faces 300,301 and grooves 304,305 the same as the full block, are two fold:

(1)The single web 306 located in the center of the block allows for a greater opening of twin open-ended end cavities in the knock-out block than said end cavities of said full block. This, i.e. the distance between the center web 306 and the grooves 304 in the end faces 301, provides greater accessibility for housing water lines, electric cables, etc. Also, concrete or insulating materials may be poured into the cavities.

(2) Placed in the end faces 301 are two spaced slots 307 that extend approximately ⅓ the depth into the end faces 301 and placed in the center web 306 are two spaced, web-crossing or continuous slots 308 that extend approximately ⅓ the depth into the center web 306. When given a sharp blow with a hammer, the parts of the end faces and the web in the spaces between the slots will knock-out giving access for reinforcing bar (steel) and concrete to be placed across and between more than one of the blocks to create beams and lintels.

The block is designed to fit into this system. Internal interlock is as per the full and half blocks.

TYPICAL INTERLOCKING METHOD FOR RUNNING BOND STRAIGHT WALL AND CORNER FULL BLOCKS

As shown in FIG. 1, any combination of end faces 102 on blocks A and B (see FIGS. 4 and 5, only one shown in FIG. 1) are placed in line and closed together at 102' in FIG. 1 and any combination of side faces 101 on block C (only one shown) is placed closed together with the other end face 102 on block B (see FIGS. 4 and 5, not shown in FIG. 1) at 101' so that the end face 102 on block C (not shown) is in line with side faces 101 on blocks A and B (not shown).

When block D is then placed on blocks A and B in a central position, the grooves 100 AD and BD located on both end walls of block D will slide down the ear 107 AD on block A and the ear 107 BD on block B. Block D is in position when the bottom face 109 of block D is in contact with the top face 108 of block A and the top face 108 of block B.

When block E is then placed on blocks B and C in a central, squared position, block E will slip down the ear 107 BE and ear 107 CE of blocks B and C, respectively.

MOLD DESIGN

In the manufacture of conventional concrete blocks only one bar 400B is used for the cores. The bar 400B is located along the top face of a mold for concrete blocks to support steel cores 401B to form a cavity or hollow in a concrete block. This causes a problem to the full block manufacturer because the area just below the core bar, wherever a web top face 403B (middle webs 103 in FIGS. 4 and 5) exists, cannot be compressed by the face of an ear-forming press. One attempt to solve this problem has been by removing a small section in the lower portion of the core bar located at the transverse top face 403B of the concrete block to obtain a thin ear-forming area. This results in a small amount of loose concrete being left on the top face 403B of the block when the concrete block is removed from the mold. The loose concrete can then removed by using pressurized air streams or rotating brushes in appropriate non-ear locations about the block once it has been removed from the mold. However, two problems remain. One problem is due to the fact that pressurized air currents cannot be used without damaging the integrity of the protruding ears. The second problem is due to the fact that for forming the protruding ears, although an ear-forming molding press having the exact form of the protruding ears is used, this malforms the resulting molded ear due to a suction effect occurring at the time of removing the mold. The suction effect causes the mold to retain some of the concrete which should have stayed on the ear. In other words, the compression shoes get dirty and have to be cleaned in every block formation cycle.

Figure 12:
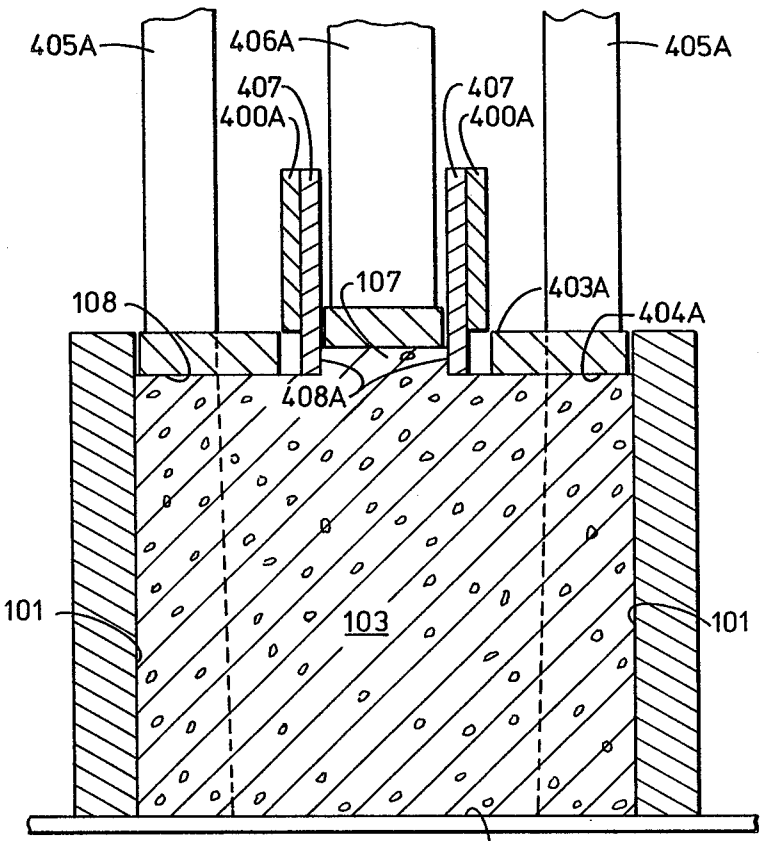
FIG. 12 is a cross-section of FIG. 11 at lines XII—XII.

For solving these problems, as shown in FIGS. 11*a* and 12, the mold method herein described uses twin, i.e. two parallel-spaced core bars 400A for supporting steel cavity-forming cores 401A in a blockforming press mold. The positions of the twin bars 400A can be approximately 6 mm from opposite longitudinal edges (114 in FIG. 4, 408A in FIG. 12) of the protruding ear 107 to a position of approximately 3 mm with relation to the external edge of the steel core.

Figure 11:
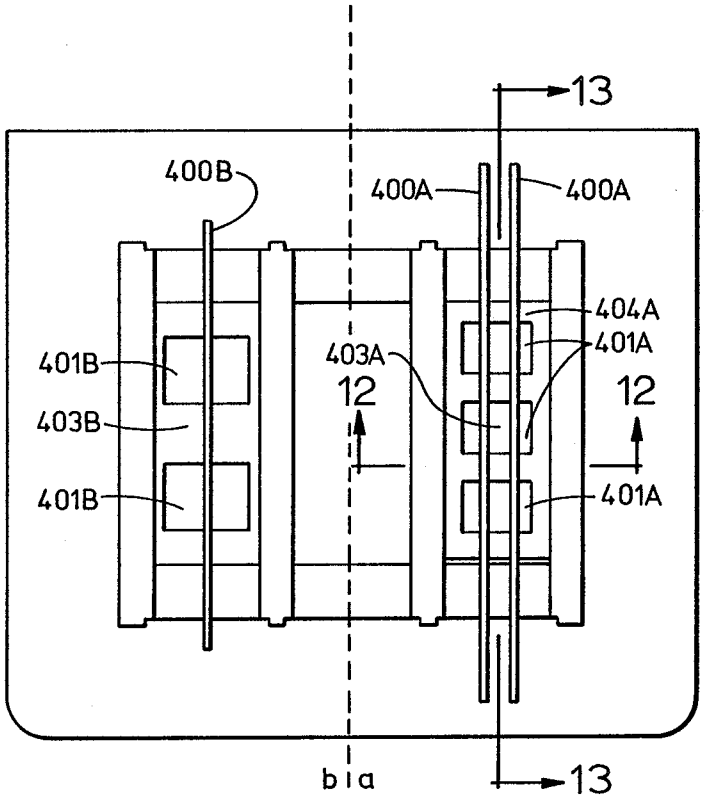
FIG. 11 is a top plan view of the shoe assembly of the block molding.
Figure 13:
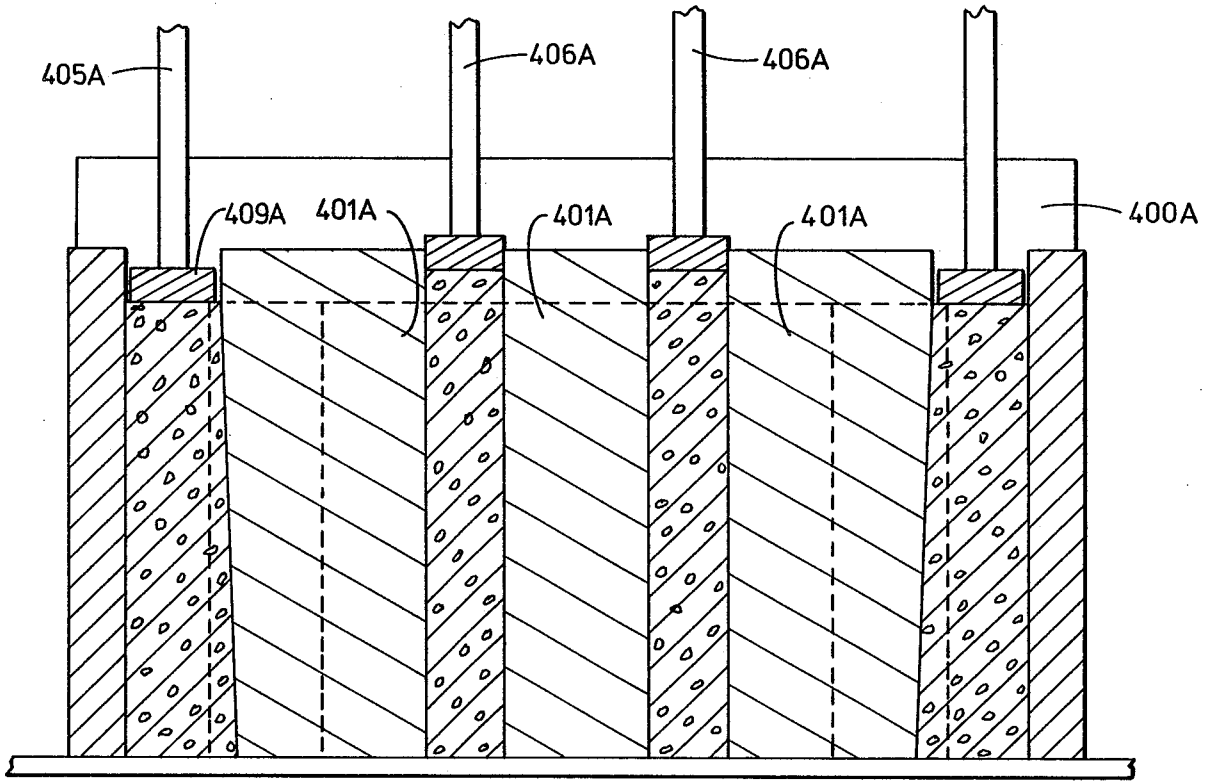
FIG. 13 is a cross-section of FIG. 11 at lines XIII—XIII.
Figure 14:
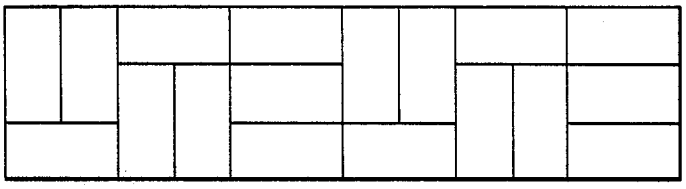
FIG. 14 is a plan view which shows a particular configuration of interlocking blocks.

Molding guides 407 on sections of the twin bars at the area of the top face 403A and extend downward between the steel cores 401A (FIG. 11) to the frits level defined by top face 404A (108 in FIG. 1) of said block aside from the ear projections. These are in the 6 mm space between the twin bars 400A and the longitudinal side face 408A of the projections at 403A as delimited by the steel cores 401A (FIG. 11). The molding guides 407 are removable.

The above allows the material to be deposited on the ear and side portions of top face 403A, 404A during a pouring cycle. Subsequently, pistons 405A, 406A of a central compression shoe press 400A compress the side and ear-projection top faces 404A, 403A, respectively. Piston 406A is shorter than pistons 405A for press molding the ear 107 projecting at 403A with, for instance, the height which varies between 1/5 and 1/25 the distance between the top and bottom faces 108, 109 of the full block. The central compression shoe press is, thus, a flat shoe molding press which facilitates removing the block, with ears, from the mold. Also the flat face of the central compression shoe or piston 406A makes it easy to clean because conventional methods can be used for this purpose.

The use of the twin bars 400A thus makes it possible to use conventional measures for cleaning the loose concrete deposited on the block face without damaging the protruding ears as mentioned before. Another benefit of the use of twin bars is that during the pouring cycle, the area between the bars can be isolated by the molding guides 407, for example, thus allowing the deposition of greater amounts of material in the area between bars, if necessary.

The method of depositing the additional material in the ear area between the twin bars is used by setting the height of a material strike off plate in the area disposed between the core bars. The adjustment of the height will depend on the type of mixture used as well as on the materials conforming said mixture.

Figure 17:
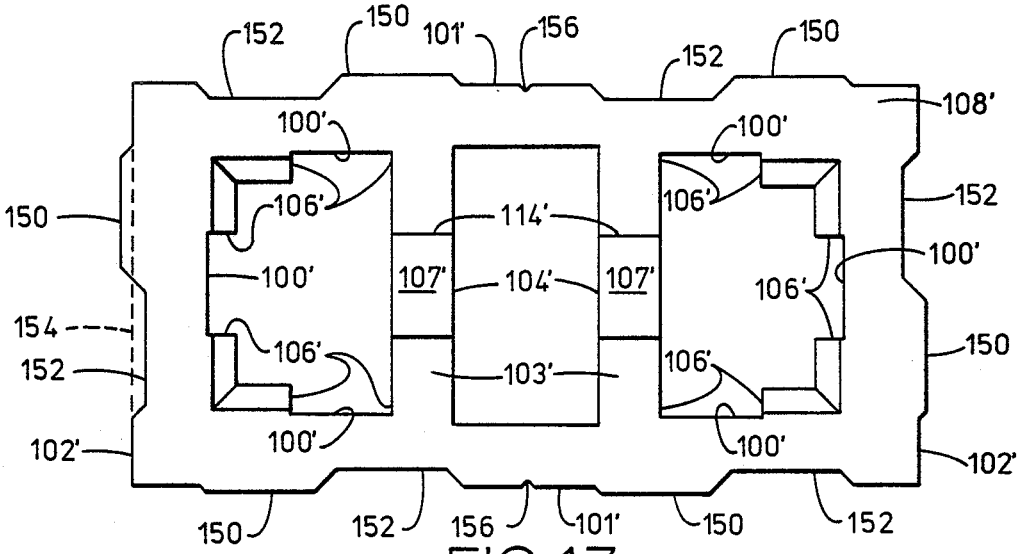
FIG. 17 is a top plan view of another full block.
Figure 16A:
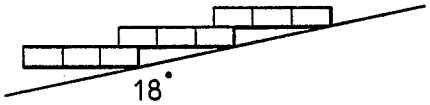
FIGS. 16 (*a*) to (*i*) show some of the many possible configurations for interlocking the full block, the half block and the knock-out block.
Figure 16B:
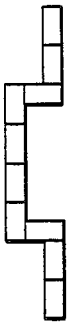
Figure 16C:
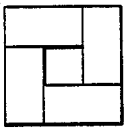
Figure 16D:
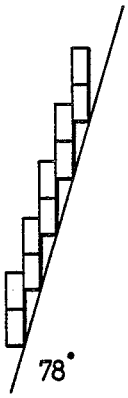
Figure 16F:
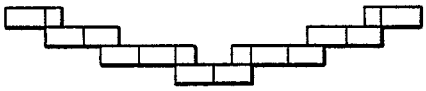
Figure 16E:
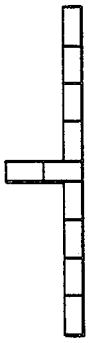
Figure 16G:
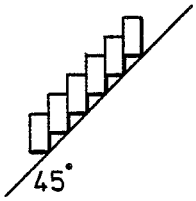
Figure 16H:
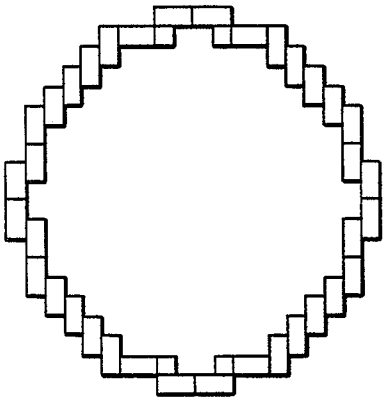
Figure 16I:
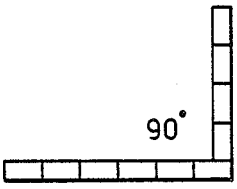

FIG. 17 shows another embodiment of the full block in the way FIG. 4 shows the embodiment already described. The embodiment of FIG. 17 is the same as that of FIG. 4, except that the external faces 101', 102' of the side and end walls of the block are contoured along axes perpendicular to the top face 108' of the block, as shown, and perpendicular to the bottom face (not shown, see 109 in FIG. 5) of the block.

The contours are such that each external face has at least one protruding portion 150 and at least one receding portion 152, the side external faces each having two of each such portions. The depth from and into the block of the protruding and receding portions of the contours together define an average face (only one shown) at 154 of each wall which is shown in phantom because not real. The average face at 154 corresponds to the face from which various distances have heretofore been described as being measured.

In the embodiment of FIG. 17, the average face of the walls corresponds with uncontoured portions of the side and end external faces 101', 102' at the ends of each wall and also at the middle of the side walls. A marker groove 156 extends parallel to the contours at the middle of the side faces to mark this location for alignment with an edge of an end or side face of another full block in a construction of such blocks. This helps get the external faces of the blocks flush in transverse orientation of the blocks and helps positioning the blocks in a construction for the grooves and ears to interlock.

The protruding and receding portions of the contours on opposite end and side faces of the block are complementarily positioned for nesting with those of another full block similarly oriented relative to the top and bottom faces when complementary end or side faces of the blocks mate. This prevents relative movement of the blocks transverse of the contours and, when there are three such blocks with the ears and grooves thereof interlocked, too, adapts the blocks for forming a rigid structure.

Figure 15:
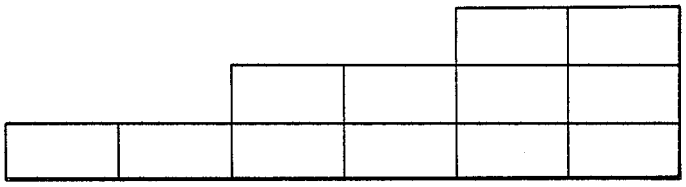
FIG. 15 shows the parallel and side by side block interlocking.

In the embodiment of FIG. 15, the side walls are twice as long between the end walls as the end walls between the side walls. The uncontoured portions at the ends of the external faces of the end walls are each about 1/6 the length of the end walls between the side walls, and the protruding and receding portions each are about ⅓ the length. The corresponding portions on the side walls are of about equal size. The depth of the protruding and receding portions is sufficient for preventing the relative movement for the adaption to a rigid structure described.

It will be understood that various other characteristics and features of the invention are apparent from the drawings and that such variations of any characteristics or feature of the invention as may occur to one of ordinary skill in the art are contemplated by the following claims to the invention.

What I claim is:

1. A building system comprising a set of three types of interlocking blocks, whereby construction of structures therewith does not require mortar, said three types of blocks of said set comprising:

a. a full block of rectangular configuration comprising: two spaced, parallel end walls and two spaced, parallel side walls extending longitudinally of said block between said end walls, said end and side walls having respective external faces, said block having top and bottom faces, and an open-ended internal cavity extending between said top and bottom faces of said block; two middle webs extending transversely of said block and parallel to said end walls between internal faces of said side walls for separating said open-ended internal cavity into two end cavities of substantially equal size and a central cavity, each said end cavity being defined by an internal face of one said end wall, one internal face of one said middle web, and the intervening internal faces of said side walls; an ear on a central portion of each said middle web, said ears being confined to and protruding from said central portions and being essentially the only protrusions from said top face, each said ear being of substantially the same dimensions, and each said ear having a transversely extending surface delimiting the extent of said ear toward said central cavity and oppositely disposed, longitudinally extending surfaces, each delimiting the extent of said ear toward the proximal said side wall; and a groove in said internal face of said end wall and each of said side walls of each said end cavity, said grooves in the internal faces of the end and side walls of each said end cavity being non-contiguous, each said groove extending from said bottom face toward said top face at least as far as said ears projects form said top face, each said groove in said internal face of said end and side walls being defined by a groove face and adjacent opposite side edges, said side edges of said groove in each said end wall each being spaced from said external face of the proximal side wall a distance substantially the same as the distance from said longitudinally extending surfaces of said ears to the external faces of the proximal side walls and each said transversely extending surface of each said ear being spaced from said external face of the proximal end wall a distance substantially one-half the external length of a side wall minus the distance of said face of said groove in the proximal end wall to said external face f said end wall; and said side edge proximal said end wall of each said groove in from said external face of said proximal end wall as the distance of each said longitudinally extending surface of each said ear to said external face of said proximal side wall, whereby an ear and groove of adjacent blocks can be male-female interlocked one external face of one block flush with an external face of the other block;

b. a half block of rectangular configuration comprising four walls, each wall having an external face and an internal face, said internal faces defining an open-ended internal cavity, two of said external faces of said half block at opposite ends of said half block each having the same configuration as said external faces of said end walls of said fullblock, but being spaces by the other two said walls of said half block half the distance between the end walls of said full block, and at least one groove in one said internal face of said half block extending from one open end of said open ended cavity for male-female fitting with one said ear of said full block in a construction of a structure; and c. a knock-out block having walls with the same external end face, side face and groove configurations as said full block, and further comprising removable means for knock-out portions of said walls which, when removed, permit insertion of reinforcement bars and the like across and between more than one of said knock-out blocks.

2. The building system according to claim 1, wherein said half block further comprises a groove on each internal face thereof, said grooves being non-contiguous.

3. The building system according to claim 2, wherein the four external faces of said half block each have the same dimension and each said groove is located in the same position with respect thereto.

4. The building system according to claim 1, wherein the half block does not have protruding ears.

5. The building system according to claim 1, wherein the knock-out block has a web between the side faces parallel to the end faces thereof and said removable means comprises slots in the end walls and web which weaken them to facilitate the breaking thereof for receiving the reinforcement bars.

6. The building system according to claim 1. and further comprising a plurality of said half blocks piled one upon another to define a cavity for reinforcing to form a column and the like.

7. The building system according to claim 1, wherein the knock-out block has no ears and only said one web for piling one upon another such to define a cavity for reinforcing to form a column and the like.

8. A full block of rectangular configuration comprising: two spaces, parallel end walls and two spaces, parallel side walls extending longitudinally of said block between said end walls, said end and side walls having respective external faces, and an open-ended internal cavity extending between top and bottom faces of said open-ended internal cavity; two middle webs extending transversely of said block and parallel to said end walls between internal faces of said side walls for separating said open-ended internal cavity into two end cavities of substantially equal size and a central cavity, each said end cavity being defined by an internal face of one said end wall, one internal face of said middle web, and the intervening internal faces of said side walls; and ear on a central portion of each said middle web, said ears being confined to and protruding from said central portion and being essentially the only protrusions from said top face, each said ear being of substantially the same dimensions; and a groove in said internal face of each of said end and side walls about each said end cavity, said grooves in the internal faces of the end and side walls of each said cavity being non-contiguous, each said groove extending from said bottom face toward said top face at least as far as said ears project from said top face and being positioned, shaped and dimensioned so that an ear and groove of adjacent blocks can be male-female interlocked with one external face of one block flush with an external face of another block for either longitudinally parallel or transverse orientations of said respective blocks.

9. The full block of claim 8, wherein said external side faces and said external end faces of said full block are contoured along axes perpendicular to said top and bottom faces of said full block so that each said face has at least one protruding and at least one receding portion, said respective protruding and receding portions mating with each other so that when an external end or side face of one said full block is in mating relationship with an external face of another said full block, relative movement of said blocks transversely of said axes is prevented.

10. The full block of claim 9, wherein at least one of said external side faces and said external end faces is contoured to have at least two said protruding portions and at least two said receding portions.

11. The full block of claim 8, wherein said external side faces and said external end faces of said full block are contoured along axes perpendicular to said top and bottom faces of said full block so that each said face has at least one protruding and at least one receding portion, said respective protruding and receding portions mating with each other so that said full block is adapted to form a rigid structure when at least two other said full blocks are interlocked between respective ears and grooves thereof.

12. A full block of rectangular configuration comprising: two spaced, parallel end walls and two spaced parallel side walls extending longitudinally of said block between said end walls, said end and side walls having respective external faces, said block having top and bottom faces and an open-ended internal cavity extending between said top and bottom faces of said block; two middle webs extending transversely of said block and parallel to said end walls between internal faces of said side walls for separating said open-ended internal cavity into two end cavities of substantially equal size and a central cavity, each said end cavity being defined by an internal face of one said end wall, one internal face of one said middle web, and the intervening internal faces of said side walls; an ear on a central portion of each said middle web, said ears being confined to and protruding from said central portions and being essentially the only protrusions from said top face, each said ear being of substantially the same dimensions, and each said ear having a transversely extending surface delimiting the extent of said ear toward said central cavity; and a groove in said internal face of each of said end and side walls about each said end cavity, said grooves in said internal faces of the end and side walls of each said end cavity being non-contiguous, each said groove extending from said bottom face toward said top face at least as far as said ears project from said top face, each said groove having a groove face, the distance from said groove face of each said groove in each said side wall of each said end cavity to said external face of the other said side wall being substantially extending surface of each said ear to the external face of the one said end wall of the said end cavity of the said internal face of the said middle web the same said ear is on.

* * * * *

UNITED STATES PATENT AND TRADEMARK OFFICE

CERTIFICATE OF CORRECTION

PATENT NO. : 4,896,472

DATED : January 30, 1990

INVENTOR(S) : Terence J. Hunt

It is certified that error appears in the above-identified patent and that said Letters Patent is hereby corrected as shown below:

Col. 7, line 62: Change "projects" to -- project --.

Col. 8, line 8: Change "f" to -- of --.

Col. 8, line 10: Before the phrase "from said external face ..." insert -- each said side wall being substantially the same distance --.

Col. 8, line 14: Change "interlocked one" to -- interlocked with one --.

Col. 8, line 24: Change "spaces" to -- spaced --.

Col. 8, line 63: Change both occurrences of "spaces" to -- spaced --.

Col. 10, line 38: Insert after the word "substantially" this phrase:

--the same as the distance from said transversely--.

Signed and Sealed this

Twelfth Day of February, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,896,472

DATED : January 30, 1990

INVENTOR(S) : Terance J. Hunt

It is certified that error appears in the above-identified patent and that said Letters Patent is hereby corrected as shown below:

Claim 8 - Column 8 - Line 68 - Delete "open-ended internal cavity" and substitute the word --block--

Claim 8 - Column 9 - Line 7 - Change "and" to --an--

Signed and Sealed this

Twenty-first Day of July, 1992

*Attest:*

DOUGLAS B. COMER

*Attesting Officer*

*Acting Commissioner of Patents and Trademarks*